US005688623A

United States Patent [19]

Nakamura et al.

[11] Patent Number: 5,688,623

[45] Date of Patent: Nov. 18, 1997

[54] CARRIER FOR DEVELOPING ELECTROSTATIC LATENT IMAGE

[75] Inventors: Minoru Nakamura, Itami; Masahiro Anno, Sakai; Makoto Kobayashi, Settsu, all of Japan

[73] Assignee: Minolta Co., Ltd., Osaka, Japan

[21] Appl. No.: 729,068

[22] Filed: Oct. 10, 1996

[30] Foreign Application Priority Data

Oct. 12, 1995 [JP] Japan ..... 7-263901

[51] Int. Cl.[6] ..... G03G 9/107; G03G 9/113

[52] U.S. Cl. ..... 430/106.6; 108/111

[58] Field of Search ..... 430/106.6, 108, 430/111

[56] References Cited

U.S. PATENT DOCUMENTS

| | | | |
|---|---|---|---|
| 4,485,162 | 11/1984 | Imamura et al. | 430/106.6 |
| 4,598,034 | 7/1986 | Honjo et al. | 430/106.6 |
| 4,614,698 | 9/1986 | Miyakawa et al. | 430/106.6 |
| 4,623,603 | 11/1986 | Iimura et al. | 430/108 |
| 4,640,880 | 2/1987 | Kawanishi et al. | 430/106.6 |
| 4,855,205 | 8/1989 | Saha et al. | 430/106.6 |
| 4,898,801 | 2/1990 | Tachibana et al. | 430/106.6 |
| 5,104,761 | 4/1992 | Saha et al. | 430/108 |
| 5,106,714 | 4/1992 | Saha et al. | 430/108 |
| 5,225,302 | 7/1993 | Isoda et al. | 430/106.6 |

*Primary Examiner*—Roland Martin

*Attorney, Agent, or Firm*—McDermott, Will & Emery

[57] ABSTRACT

A carrier for developing electrostatic latent image includes a ferrite core particle which contains MnO and 0.5 to 4 molar percent of CaO, and a resin coating layer formed on the core particle.

18 Claims, No Drawings

CARRIER FOR DEVELOPING ELECTROSTATIC LATENT IMAGE

BACKGROUND OF THE INVENTION

1. Field of the Invention

The present invention relates to a carrier for developing electrostatic latent images used in electrophotographic type copying apparatuses, printers, facsimile apparatuses, and the like.

2. Description of the Related Art

Two-component developers used in electrophotographic image forming apparatuses such as dry-type copying apparatus generally comprise two components of a fine toner and a carrier which is larger than the toner. Toner and carrier are electrostatically charged so as to have respective charges of opposite polarity by means of the friction produced by mixing the two-component developer. Toner charged in this manner forms a visible image by being electrostatically adhered to an electrostatic latent image formed on the surface of a photosensitive member, thus obtained visible image is transferred onto a recording medium, and fixed thereon to produce a copy.

Ferrite which is represented by the general formula $MO{\cdot}Fe_2O_3$ (where M is a metal atom) and iron powder are known to be used as conventional carriers for developing electrostatic latent images. Ferrite carrier is currently the most widely used carrier and has excellent magnetic characteristics. Experiments changing the constituents of the core particles have been performed to improve the image characteristics of ferrite carrier. For example, U.S. Pat. No. 4,598,034 discloses a carrier for developing electrostatic latent images containing copper oxide and zinc oxide.

A disadvantage of fog generation on the surface of the photosensitive member occurs, however, when conventional carriers are used for developing under high temperature and high humidity environmental conditions. The fog is believed to be caused when a bias voltage is applied in the apparatus causing a charge injection from the developing sleeve to the carrier which produces a reversal of the polarity of the toner present in the developing region and causes toner adhesion on the non-latent image area of the photosensitive member. Fog on the surface of the photosensitive member is a problem which occurs frequently in small particle toners which have a small amount of charge per individual particle.

On the other hand, conventional carrier produces carrier adhesion on the surface of the photosensitive member under environmental conditions of low temperature and low humidity. The carrier adhesion is thought to occur due to carrier migration form the developing sleeve and adhesion on the photosensitive member when there is low carrier magnetization saturation.

SUMMARY OF THE INVENTION

An object of the present invention is to provide a novel and useful carrier for developing electrostatic latent images which eliminates the previously described disadvantages of conventional carriers.

Another object of the present invention is to provide a carrier for developing electrostatic latent images which has excellent magnetic characteristics.

Another object of the present invention is to provide a carrier for developing electrostatic latent images which prevents fogging on the surface of the photosensitive member under conditions of high temperature and high humidity.

A further object of the present invention is to provide a carrier for developing electrostatic latent images which prevents carrier adhesion under conditions of low temperature and low humidity.

A still further object of the present invention is to provide a carrier for developing electrostatic latent images which fogging on the surface of the photosensitive member when a toner having a small particle is used.

These objects are attained by a carrier comprising:

(a) a ferrite core particle which contains CaO and MnO, said CaO being contained in an amount of 0.5 to 4 percent by molar on the basis of the core particle; and (b) a resin coating layer formed on the core particle.

And further, these objects are attained by a carrier comprising a core particle coated with a resin and having a static electric resistance of $1\times10^8$ to $5\times10^9\Omega{\cdot}cm$, a dynamic current of 0.2 to 1.0 μA and a saturated magnetization of 65 to 80 emu/g.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

The carrier of the present invention comprises core particles with a resin overcoating on the core particles. The present inventors conducted various investigations and discovered that carrier electrical resistance and magnetization saturation can be increased by controlling the constituents of the ferrite core particles, resulting in the present invention.

That is, the present invention provides a carrier wherein the ferrite core particles contain CaO to increase the electric resistance value and improve environmental resistance properties under conditions of high temperature and high humidity on the one hand, and ferrite core particles contain MnO to increase carrier magnetization saturation and improve environmental resistance properties under conditions of low temperature and low humidity on the other hand.

It is desirable that the manganese oxide content of the ferrite used as carrier core particles is 2 to 20 molar percent. When the MnO content is less than 2 molar percent, sufficient magnetization saturation may not be obtained, leading to concern of carrier adhesion on the surface of the photosensitive member under environmental conditions of low temperature and low humidity. On the other hand, when the MnO content exceeds 20 molar percent, the elevation of magnetization saturation peaks, such that further increase produces an undesirable reduction trend in the magnetization saturation.

It is desirable that the calcium oxide content of the ferrite used as carrier core particles is 0.5 to 5 molar percent. When the CaO content is less than 0.5 molar percent, the magnetic resistance of the ferrite particles is reduced so as to cause concern of fogging on the surface of the photosensitive member under environmental conditions of high temperature and high humidity. Furthermore, when the CaO content exceeds 5 molar percent, there is concern that the mechanical strength of the carrier may be undesirably reduced.

In addition to the aforementioned constituents, that is, $Fe_2O_3$, MnO, and CaO, the ferrite particles may also contain ZnO and/or CuO. Total amount of MnO and the component selected from ZnO and CuO of the ferrite core particles is desirably such that molar ratio relative to the ferrite is in a range of 0.2 to 0.5 (20 to 50 molar percent). Particularly desirable ferrite core particles will contain both ZnO and CuO.

That is, the chemical structure of a desirable ferrite particle is illustrated by chemical formula [I] below;

$$(MO)_x(CaO)_y(Fe_2O_3)_z \quad [I]$$

(Where M represents the combination of one or more metal selected from the group consisting of Mn, Zn, and Cu; x, y, and z represent the molar fraction of MO, CaO, and $Fe_2O_3$; $x+y+z=1$, x=0.2 to 0.5, y=0.005 to 0.05, and z=0.5 to 0.8).

The ferrite core particles may be prepared by the same methods as normal ferrite carriers. That is, $Fe_2O_3$, CaO, and MnO to achieve a specific molar ratio, ZnO and CuO as desired, or metal salts to produce an ultimately desired oxide may be pulverized and mixed, then dried, pulverized and calcined to obtain a calcined powder to be disintegrated to suitable size, and subsequently granulated using a granulation device, and being subjected to firing.

The ferrite carrier is provided with a resin overcoating layer on a ferrite core particle. The resins used for the overcoat layer include, for example, various thermoplastic and thermosetting resins such as polystyrene resin, poly (meth)acrylate resin, polyolefin resin, polyamide resin, polycarbonate resin, polyether resin, polysulfone resin, polyester resin, epoxy resin, polybutyral resin, urea resin, urethane resin, silicon resin, teflon resin and the like, derivatives and mixtures thereof, and copolymers, block polymers, graft polymers, and polymer blends thereof. Various types of resins having polar groups may be used to adjust charging characteristics. Among these resins, the use of thermosetting silicone resins, particularly thermosetting acrylic silicone resin is desirable.

The resin overcoating method may include preparing a resin liquid of the aforementioned overcoat resin dissolved in a suitable solvent and applying the resin liquid to the core particles by spray or immersion methods. Particularly desirable are immersion methods wherein carrier core particles in a state of immersion in an overcoat resin liquid are stirred and heated to eliminate the solvent, and subsequently dried and subjected to a heating process to accomplish the overcoating. Immersion methods are desirable from the perspective of achieving a uniform overcoating when a thermosetting resin is used as the overcoat resin.

The amount of overcoat resin relative to the core particle is preferably 0.3 to 1.3 percent-by-weight. The effectiveness of the overcoating layer may be inadequate when the overcoat resin is less than 0.3 percent-by-weight, which adversely affects environmental resistance. Although carrier electrical resistance is increased by increasing the amount of overcoat resin, the flow characteristics of the coat carrier may be adversely affected when the amount of overcoat resin exceeds 1.3 percent-by-weight.

The weight-average particle size of the carrier is 30 to 80 μm, and preferably 40 to 60 μm.

The aforementioned carrier can be used with toner in two-component developers. The carrier is particularly useful when used with a small particle toner for full color image formation.

The resin overcoat carrier used will have an static electric resistance value of $1\times10^8$ to 5×109Ω·cm, and preferably $5\times10^8$ to $5\times10^9$Ω·cm, a dynamic current value of 0.2 to 1.0 μA, and preferably 0.2 to 0.8 μA, and a saturation magnetization value of 65 to 80 emu/g, and preferably 68 to 75 emu/g. When the static electric resistance value is less than $1\times10^8$Ω·cm, fine line reproducibility tends to be reduced, and when it exceeds $5\times10^9$Ω·cm, image density tends to be reduced under environmental conditions of low temperature and low humidity. When the dynamic current value exceeds 1.0 μA, fogging readily occurs under environmental conditions of high temperature and high humidity, and when the value is less than 0.2 μA, fogging readily occurs under conditions of low temperature and low humidity. When the saturation magnetization value is less than 65 emu/g, carrier adhesion readily occurs under conditions of low temperature and low humidity. The static electric resistance of the core particles is desirably $1\times10^8$ to $5\times10^9$Ω·cm, and preferably $5\times10^8$ to $5\times10^9$Ω·cm.

Although the present invention is fully described in detail hereinafter by way of examples, it is to be understood that the present invention is not limited to these examples and may be variously modified.

Carrier Preparation 1

Core particle mix ratio of 15 molar percent CuO, 10 molar percent ZnO, 3 molar percent MnO, 2 molar percent CaO, and 70 molar percent $Fe_2O_3$ were pulverized in a wet type ball mill for mixing, and the material was subsequently dried, pulverized, and calcined at 700° to 1,000° C. To obtain a calcined powder of 5 μm or less, the material was baked for 8 hr at about 1,200° C. to less than 200 μm using a granulation device (Spray Dryer; made by Ogawara Koki K.K.). The calcined product was disintegrated and classified to obtain carrier core particle a having an average particle size of 50 μm.

Silicone resin (KR251; made by Shin-Etsu Chemical Industries Co., Ltd.) was diluted with methylethyl ketone to prepare an overcoat liquid having a solid ratio of 2%, and 60 parts by weight of the overcoat liquid and 100 parts by weight carrier core particle a were introduced into a mixer capable of stirring and heating at reduced pressure to accomplish a drying process. The carrier core particles were provided with a resin overcoating by mixing, and after the resin overcoating was hardened by heating for 30° min at 150° C., the material was disintegrated in a pulverization device, and classified using a 90 μm mesh filter, then subjected to magnetic separation to eliminate low magnetic strength constituents and obtain a resin overcoat ferrite carrier A.

Carrier Preparation 2

Carrier core particle b was prepared in the same manner as carrier preparation 1 with the exception that the carrier core particle mix ratio was 15 molar percent CuO, 10 molar percent ZnO, 5 molar percent MnO, 4 molar percent CaO, and 66 molar percent $Fe_2O_3$.

The resin overcoat ferrite carrier B was prepared in the same manner as in carrier preparation 1 with the exception that weight ratio of carrier core particle b to overcoat liquid was 50:100.

Carrier Preparation 3

Resin overcoat ferrite carrier C was obtained in the same manner as in carrier preparation 1 with the exception that an acryl-modified silicone resin (KR9706; made by Sin-etsu Chemical Industries Co., Ltd.) was used as the overcoat resin, and the weight ratio of carrier core particles to overcoat liquid was 70:100.

Carrier Preparation 4

Resin overcoat ferrite carrier D was obtained in the same manner as in carrier preparation 1 with the exception that the core particle mix ratio was 15 molar percent CuO, 10 molar percent ZnO, 3 molar percent MnO, and 72 molar percent $Fe_2O_3$.

Carrier Preparation 5

Resin overcoat ferrite carrier E was obtained in the same manner as in carrier preparation 1 with the exception that the core particle mix ratio was 15 molar percent CuO, 10 molar percent ZnO, 2 molar percent CaO, and 73 molar percent $Fe_2O_3$.

Carrier Preparation 6

Resin overcoat ferrite carrier F was obtained in the same manner as in carrier preparation 5 with the exception that the amount of resin overcoat was 1.5 percent-by-weight.

Measurement of Carrier Properties (1) Particle size

Average particle size of carrier particle was measured using a laser diffraction type particle size distribution measuring device (SALD-1100; made by Shimadzu Seisakusho Co., Ltd.).

(2) Resin overcoat quantity

Carrier resin overcoat quantity was measured by precisely measuring 10 g of carrier, calcining the sample for 3 hr at 800° C., and determining the difference of the amount of original material and that of residue after calcining.

(3) Static electric resistance

Static electric resistance was determined using a specimen 50 mm in diameter and 1 mm thickness on a circular metal electrode, an electrode with a mass of 895.4 g and 20 mm in diameter, and guard electrode 38 mm in interior diameter and 42 mm in exterior diameter. The current value was read after 1 min of 500 V DC voltage application, and calculating the specimen volume resistivity value (ρ). The measurement environment was a temperature of 25°±1° C. and relative humidity of 55±5%. The measurement was repeated five times, and the average value was obtained.

(4) Saturation magnetization

Saturation magnetization was measured using a DC magnetic characteristics recording device type 3257 (made by Yokogawa Denki K.K.).

(5) Dynamic current value

A precision scale was used to weigh 1 g of carrier which was uniformly applied to the entire surface of an electrically conductive sleeve, and a magnet roller with alternative N-pole and S-pole and having a magnetic flux density of 1,000 Gauss and rotating at 80 rpm was provided within the conductive sleeve. A gap of 0.8 mm was set between the conductive sleeve and a photosensitive drum, and the magnet roller was rotated as a bias voltage of 300 V was applied from a bias power source. The potential of the photosensitive drum was read, and the current value of the sample was calculated. The measurement environment was a temperature of 25°±1° C. and relative humidity of 55±5%. The measurement was repeated five times, and the average value was obtained.

The obtained carrier characteristics values are shown in Table 1 below.

TABLE 1

| Carrier | Resin over-coat (wt %) | Weight average particle size (μm) | Saturation magneti-zation (emu/g) | Static electric resistance (Ω · cm) Core | Static electric resistance (Ω · cm) Carrier | Dynamic Current (μA) |
|---|---|---|---|---|---|---|
| core a | 0 | 50 | 70 | $2 \times 10^9$ | $2 \times 10^9$ | 1.2 |

TABLE 1-continued

| Carrier | Resin over-coat (wt %) | Weight average particle size (μm) | Saturation magneti-zation (emu/g) | Static electric resistance (Ω · cm) Core | Static electric resistance (Ω · cm) Carrier | Dynamic Current (μA) |
|---|---|---|---|---|---|---|
| A | 1.0 | 50 | 70 | $2 \times 10^9$ | $2 \times 10^9$ | 0.6 |
| B | 0.8 | 40 | 71 | $2 \times 10^9$ | $4 \times 10^9$ | 0.3 |
| C | 1.2 | 40 | 70 | $2 \times 10^9$ | $2 \times 10^9$ | 0.3 |
| D | 1.0 | 50 | 70 | $3 \times 10^9$ | $4 \times 10^8$ | 1.4 |
| E | 1.0 | 50 | 64 | $2 \times 10^9$ | $2 \times 10^9$ | 0.8 |
| F | 1.5 | 50 | 64 | $2 \times 10^9$ | $8 \times 10^9$ | 0.1 |

Preparation of Toner A

| Component | Parts by weight |
|---|---|
| *Styrene | 60 |
| *n-butylmethacrylate | 35 |
| *methacrylate | 5 |
| *2,2-azobis-(2,4-dimetylvaleronitrile | 0.5 |
| *Low molecular weight polypropylene (Viscol 605P; Sanyo Kasei Kogyo K.K.) | 3 |
| *Carbon black (MA#8; Mitsubishi Kagaku K.K.) | 8 |

The aforementioned materials were mixed using a sand stirrer to prepare a polymerizable mixture. The polymerizable mixture was agitated in 3% arabian rubber aqueous solution using a TK Autohomomixer (made by Tokushu Kika Kogyo K.K.) at 4,000 rpm, and simultaneously heated at 60° C. to initiate a polymerization reaction and obtain spherical particles having an average particle size of 6 μm. Separately, salicylic acid metal complex (E-84; made by Orient Chemical Industries Co., Ltd.) and hydrophobic titanium oxide (T-805; made by Nippon Aerosil K.K.) were prepulverized in an aqueous medium at a weight ratio of 1:1 using a sand mill (Paint Conditioner; made by Red Devil K.K.). The obtained salicylic acid metal complex/titanium oxide mixture was added to at a rate of 1.5 parts by weight to 100 parts by weight spherical particle solid of aforementioned spherical particle dispersion, and thereafter continuously mixed to obtain spherical particle with a surface overcoating of salicylic acid metal complex/titanium oxide. Subsequently, the material was filtered, washed repeatedly, and then the cake-like particles were dried for 5 hr at 80° C. using a heated air drier to cause agglomeration of the particles, and particularly very fine particles less than 1 μm were anchored to the surface of particles of 3 μm and larger, and the material was fused to obtain agglomerant of about 50 μm to 1 mm. This agglomerant was subjected to disintegration and surface improvement processing using a Kryptron system (KTM-X; made by Kawasaki Heavy Industries Co., Ltd.) to obtain disintegrated particles having an average particle size of 6 μm. As a post processing, 0.2 parts by weight hydrophobic silica (H-2000; made by Wakker K.K.) was added to 100 parts by weight disintegrated particles, and mixed in a Henschel mixer (made by Mitsui-Miike Kakoki K.K.) at 1,000 rpm for 1 min to obtain toner A.

Preparation of Toner B 100 g of polyester resin (NE-382; made by Kao Co., Ltd.) were dissolved in 400 g of a mixed solvent comprising methylene chloride and toluene (8/2), and to this was added 5 g phthalocyanine pigment and 5 g salicylic acid metal complex (E-84; made by Orient Chemical Industries Co., Ltd.) and all materials were mixed in a ball mill for 3 hr to obtain a uniform dispersion fluid. Then, 60 g of a 4% solution of methyl cellulose (made by Metocell K35LV; Dow Chemical Co., Ltd.) as a dispersion stabilizer, 5 g of a 1% solution of dioctylsulfosuccinate soda (made by Nikkole OTP75; Nikko Chemical K.K.), and 0.5 g of hexamethacrylate soda (made by Wako Fine Chemicals Industries Ltd.) were dissolved in 1,000 g ion-exchange water were added to the TK Autohomomixer (made by Tokushu Kika Kogyo K.K.) and mixed to obtain a uniform dispersion liquid with an average particle size of 3 to 10 μm in an aqueous suspension. 1.0 parts by weight hydrophobic silica (OX50; made by Nippon Aerosil K.K.) previously dispersed in methanol was added to the aforementioned suspension containing 100 parts by weight of resin, and mixed to adhere the silica microparticles to the surface of the suspension particles. Thereafter, the material was filtered, washed repeatedly, then the particles were dried using a slurry drier (Dispercoat; Nisshin Engineering K.K.), and finally forced-air classified to obtain colored particles having an average particle size of 6 μm. As a post processing, 0.3 parts by weight hydrophobic silica (H-2000; made by Wakker K.K.) and 0.5 parts by weight hydrophobic titanium oxide (T-805; made by Nippon Aerosil K.K.) were added to 100 parts by weight of the obtained colored particles, and mixed for 1 min at 1,000 rpm using a Henschel mixer (made by Mitsui-Miike Kakoki K.K.) to obtain toner B.

Preparation of Toner C

| Component | Parts by weight |
|---|---|
| *Polyester resin (softening point: 130° C.; glass transition temperature: 60° C.; acid value (AV): 24; OH value (OHV): 38) | 100 |
| *Carbon black (MA#8; Mitsubishi Kagaku K.K.) | 8 |
| *Charge control agent (Spilon Black TRH; Hodogaya Kagaku K.K.) | 3 |

The aforementioned materials were thoroughly mixed using a ball mill, and kneaded using three rollers heated to 140° C. After the kneaded material was allowed to stand to cool, it was coarsely pulverized using a feather mill, then finely pulverized using a jet mill. The material was then forced-air classified to obtain colored particles having an average particle size of 6 μm. As a post processing, 0.2 parts by weight hydrophobic silica (H-2000; made by Wakker K.K.) was added to 100 parts by weight of the obtained colored particles and mixed for 1 min in a Henschel mixer (made by Mitsui-Miike Kakoki K.K.) at 1,000 rpm to obtain toner C.

Preparation of Toner D

| Component | Parts by weight |
|---|---|
| *Polyester resin (Toughton NE832; Kao Co., Ltd.) | 100 |
| *Brilliant carmine 6B (CI. 15850) | 3 |
| *calix arene compound (E-89; Orient Chemical Industries Co., Ltd.) | 2 |

The aforementioned materials were thoroughly mixed using a ball mill, and kneaded using three rollers heated to 140° C. After the kneaded material was allowed to stand to cool, it was coarsely pulverized using a feather mill, then finely pulverized using a jet mill. The material was then forced-air classified to obtain colored particles having an average particle size of 6 μm. As a post processing, 0.2 parts by weight hydrophobic silica (H-2000; made by Wakker K.K.) was added to 100 parts by weight of the obtained colored particles and mixed for 1 min in a Henschel mixer (made by Mitsui-Miike Kakoki K.K.) at 1,000 rpm to obtain toner D.

Evaluation

Toners A through D, carriers A through F and core carrier particle a were mixed in combination as shown in Table 2 to achieve a toner concentration of 5 percent-by-weight for use as developers under both conditions of high temperature/high humidity and low temperature/low humidity in examples 1 through 5 and reference examples 1 through 4 using a copying machine model Di-30 (made by Minolta Co., Ltd.), and the developer of example 6 was used in a full-color copying machine model CF-70 (made by Minolta Co., Ltd.) to investigate image density, fogging of the surface of the photosensitive member, and carrier adhesion. Evaluation results are shown in Table 2.

(1) Evaluation of Image Density

The image density of a solid image was measured using a Sakura Densitometer model PDA65. An image density higher than 1.3 was rated O, a density of 1.1 to 1.3 was rated Δ, and a density less than 1.1 was rated X.

(2) Evaluation of Photosensitive Member Fog

Evaluation of fog was accomplished by visual inspection of the photosensitive member surface bearing a formed toner image. The absence of fog and toner in the non-image region of the photosensitive member was rated O, slight fog posing no practical problem was rated Δ, and extreme definite fog was rated X.

High temperature/high humidity (H/H) conditions were 30° C. and 85% RH, and were evaluated initially. Low temperature/low humidity (L/L) conditions were 5° C. and 15% RH, and were evaluated after 10,000 sheets printings.

(3) Evaluation of Carrier Adhesion

Carrier adhesion was evaluated by visual inspection of the photosensitive member surface bearing a formed toner image. The absence of toner adhesion in the non-image area of the photosensitive member was rated O, slight toner adhesion posing no practical problem was rated Δ, and definite toner adhesion was rated X.

Evaluation results are shown in Table 2.

TABLE 2

| | | | Image | Fog on Photosensitive member | | Carrier |
|---|---|---|---|---|---|---|
| | Toner | Carrier | density | L/L | H/H | adhesion |
| Ex. 1 | A | A | ○ | ○ | ○ | ○ |
| Ex. 2 | B | A | ○ | ○ | ○ | ○ |
| Ex. 3 | C | A | ○ | ○ | ○ | ○ |
| Ex. 4 | C | B | ○ | ○ | ○ | ○ |
| Ex. 5 | C | C | ○ | ○ | ○ | ○ |
| Ex. 6 | D | A | ○ | ○ | ○ | ○ |
| Ref. 1 | C | D | ○ | x | ○ | Δ |
| Ref. 2 | C | E | ○ | ○ | Δ | x |
| Ref. 3 | C | core a | Δ | Δ | x | Δ |

TABLE 2-continued

| | Toner | Carrier | Image density | Fog on Photosensitive member L/L | Fog on Photosensitive member H/H | Carrier adhesion |
|---|---|---|---|---|---|---|
| Ref. 4 | C | F | ○ | ○ | x | x |

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A carrier for developing electrostatic latent image comprising:

(a) a ferrite core particle which contains CaO, MnO and at least one component selected from the group consisting of CuO and ZnO, said CaO being contained in an amount of 0.5 to 4 molar percent on the basis of the core particle, said MnO being contained in an amount of 2 to 20 molar percent on the basis of the core particle; and (b) a resin overcoating layer formed on a surface of the core particle.

2. The carrier as claimed in claim 1 wherein total amount of the MnO and the component selected from the group consisting of CuO and ZnO is in the range of 20 to 50 molar percent on the basis of the core particle.

3. The carrier as claimed in claim 2 which contains CuO and ZnO.

4. The carrier as claimed in claim 1 which contains $Fe_2O_3$ of 20 to 50 molar percent on the basis of the core particle.

5. The carrier as claimed in claim 1 wherein said coating layer is contained in an amount of 0.3 to 1.3 percent by weight on the basis of the core particle.

6. The carrier as claimed in claim 5 which has a dynamic current of 0.2 to 1.0 μA.

7. The carrier as claimed in claim 5 wherein said coating layer comprises silicone resin.

8. The carrier as claimed in claim 7 wherein said silicone resin comprises thermosetting silicone resin.

9. The carrier as claimed in claim 8 wherein said thermosetting resin comprises thermosetting acryl-modified silicone resin.

10. The carrier as claimed in claim 5 which is obtained by a process comprising steps of:

dipping the core particle in a resin solution;

forming a resin overcoating layer on the core particle by stirring and heating the solution which contains the core particle; and curing the resin layer by heating.

11. A carrier for developing electrostatic latent image comprising a core particle coated with a resin and having a static electric resistance of $1\times10^8$ to $5\times10^9\Omega\cdot$cm, a dynamic current of 0.2 to 1.0 μA and a saturated magnetization of 65 to 80 emu/g.

12. The carrier as claimed in claim 11 wherein said core particle has a static electric resistance of $1\times10^8$ to $5\times10^9\Omega\cdot$cm.

13. The carrier as claimed in claim 12 which has a dynamic current of 0.2 to 0.8 μA.

14. The carrier as claimed in claim 13 which has a saturated magnetization of 68 to 75 emu/g.

15. The carrier as claimed in claim 11 wherein a resin overcoating layer is contained in an amount of 0.3 to 1.3 percent by weight on the basis of the core particle.

16. The carrier as claimed in claim 15 wherein said resin overcoating layer comprises silicone resin.

17. The carrier as claimed in claim 16 wherein said silicone resin comprises thermosetting silicone resin.

18. The carrier as claimed in claim 15 which is obtained by a process comprising steps of:

dipping the core particle in a resin solution;

forming a resin overcoating layer on the core particle by stirring and heating the solution which contains the core particle; and curing the resin overcoating layer by heating.

* * * * *